US012458179B2

(12) United States Patent
Chicca et al.

(10) Patent No.: US 12,458,179 B2
(45) Date of Patent: Nov. 4, 2025

(54) FOLDING BABY BATH SEAT

(71) Applicant: KIDS2, LLC, Atlanta, GA (US)

(72) Inventors: Dana Chicca, Somerset, MA (US); Robert Blackadar, Worcester, MA (US)

(73) Assignee: KIDS2, LLC, Atlanta, GA (US)

( * ) Notice: Subject to any disclaimer, the term of this patent is extended or adjusted under 35 U.S.C. 154(b) by 140 days.

(21) Appl. No.: 18/351,034

(22) Filed: Jul. 12, 2023

(65) Prior Publication Data

US 2024/0016343 A1 Jan. 18, 2024

Related U.S. Application Data

(60) Provisional application No. 63/388,570, filed on Jul. 12, 2022.

(51) Int. Cl.
*A47K 3/12* (2006.01)
*A47D 1/02* (2006.01)

(52) U.S. Cl.
CPC ..... *A47K 3/127* (2013.01); *A47D 1/02* (2013.01)

(58) Field of Classification Search
CPC ..... A47K 3/024; A47K 3/034; A47K 3/064; A47K 3/127; A47K 3/074; A47D 1/02
See application file for complete search history.

(56) References Cited

U.S. PATENT DOCUMENTS

| | | | | |
|---|---|---|---|---|
| 243,573 | A | 6/1881 | Jones | |
| 2,249,107 | A | 7/1941 | Baxter et al. | |
| 2,481,577 | A | 9/1949 | De et al. | |
| 5,425,149 | A | 6/1995 | Crossley et al. | |
| 6,253,392 | B1 | 7/2001 | Conforti et al. | |
| 6,361,106 | B1 * | 3/2002 | Huang | A47D 13/101 297/16.1 |
| 7,065,805 | B1 * | 6/2006 | Sundberg | A47K 3/127 5/103 |
| 9,055,847 | B1 | 6/2015 | Flannery et al. | |
| 9,622,622 | B2 | 4/2017 | Sundberg et al. | |
| 9,962,041 | B1 | 5/2018 | Flannery et al. | |
| 2011/0127810 | A1 * | 6/2011 | Lee | A47D 13/101 297/16.1 |

(Continued)

FOREIGN PATENT DOCUMENTS

| | | |
|---|---|---|
| CN | 202776060 U | 3/2013 |
| CN | 204708718 U | 10/2015 |
| CN | 204931505 U | 1/2016 |

(Continued)

OTHER PUBLICATIONS

Machine Translation for CN 207544747 U (Year: 2025).*

(Continued)

*Primary Examiner* — Janie M Loeppke
(74) *Attorney, Agent, or Firm* — Adler Pollock & Sheehan P.C.

(57) ABSTRACT

A foldable baby bath seat assembly includes a seat assembly supported by a foldable frame assembly having a forward floor-engaging portion pivotally coupled to a rear floor-engaging portion via a folding mechanism. The folding mechanism has first and second pivoting assemblies on opposite sides of the frame assembly, each of which comprises an actuator that allows the rear floor-engaging portion to pivot with respect to the seat assembly.

2 Claims, 4 Drawing Sheets

(56) References Cited

U.S. PATENT DOCUMENTS

| | | | |
|---|---|---|---|
| 2022/0079390 | A1 | 3/2022 | Pruzhansky et al. |
| 2022/0095847 | A1 | 3/2022 | Craine |

FOREIGN PATENT DOCUMENTS

| | | | | |
|---|---|---|---|---|
| CN | 106974577 | A | | 7/2017 |
| CN | 107550354 | A | | 1/2018 |
| CN | 207544747 | U | * | 6/2018 |
| CN | 108991962 | A | | 12/2018 |
| CN | 208481182 | U | | 2/2019 |
| CN | 208740820 | U | | 4/2019 |
| CN | 209058982 | U | | 7/2019 |
| CN | 209450403 | U | | 10/2019 |
| CN | 209984106 | U | | 1/2020 |
| CN | 210471994 | U | | 5/2020 |
| CN | 210748934 | U | | 6/2020 |
| CN | 211749179 | U | | 10/2020 |
| CN | 212186298 | U | | 12/2020 |
| CN | 212368850 | U | | 1/2021 |
| CN | 215127791 | U | | 12/2021 |
| CN | 215533862 | U | | 1/2022 |
| KR | 20130004720 | U | | 8/2013 |

OTHER PUBLICATIONS

"International Search Report and Written Opinion received for PCT Patent Application No. PCT/US2023/070031, mailed on Nov. 6, 2023", 7 pages.

"Summer Infant Deluxe Baby Bather", Accessed online via: <https://www.youtube.com/watch?v=P8GPwcMf2mU&ab_channel=SummerInfantUK>, 2 pages [accessed Oct. 13, 2023].

Guangzhou , "Infant Deluxe Baby Bather", Retrieved Online via <https://www.alibaba.com/product-detail/Infant-Deluxe-Baby-Bather_62525155252.html>, 5 pages [accessed Oct. 13, 2023].

LuvLap , "LuvLap Friendly Turtle Baby Bather, Dark Blue", Retrieved online via <https://www.luvlap.com/friendly-turtle-baby-bather-dark-blue.html>, 3 pages [accessed Oct. 13, 2023].

* cited by examiner

FOLDING BABY BATH SEAT

CROSS REFERENCE TO RELATED APPLICATIONS

This application claims priority from U.S. Provisional Patent Application No. 63/388,570 filed Jul. 12, 2022, the contents of all which are incorporated herein by reference in its entirety.

BACKGROUND

Field

The present disclosure relates generally to the field of children's products, and more particularly to a bath seat or bather that is adjustable and comfortable for an infant or child.

Description of the Problem and Related Art

Bathtubs are generally sized and adapted for an adult's use. Traditional bathtubs may become dangerous with a risk of drowning for an infant or young child that is not able to sit up independently in the bathtub.

Accordingly, it can be seen that needs exist for improvements in bath seats for assisting a caregiver with keeping an infant or young child safe during bathing. It is to the provision of a solutions meeting these and other needs that the present disclosure is primarily directed.

SUMMARY

For purposes of summary, certain aspects, advantages, and novel features are described herein. It is to be understood that not necessarily all such advantages may be achieved in accordance with any one particular embodiment. Thus, the apparatuses or methods claimed may be embodied or carried out in a manner that achieves or optimizes one advantage or group of advantages as taught herein without necessarily achieving other advantages as may be taught or suggested herein.

In example embodiments, the present disclosure provides a baby bather or bath seat for keeping a child comfortable and safe during a bath. Generally, the baby bather is configured for supporting a child above a support surface. The bath seat comprises a seat assembly coupled to a frame assembly. The bath seat further includes a folding mechanism that is configured to adjust the recline of the bath seat and to assist with folding the bath seat into a flat configuration.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

BRIEF DESCRIPTION OF THE DRAWINGS

The apparatus is described with reference to the accompanying drawings. In the drawings, like reference numbers indicate identical or functionally similar elements.

DETAILED DESCRIPTION

Figure 1:
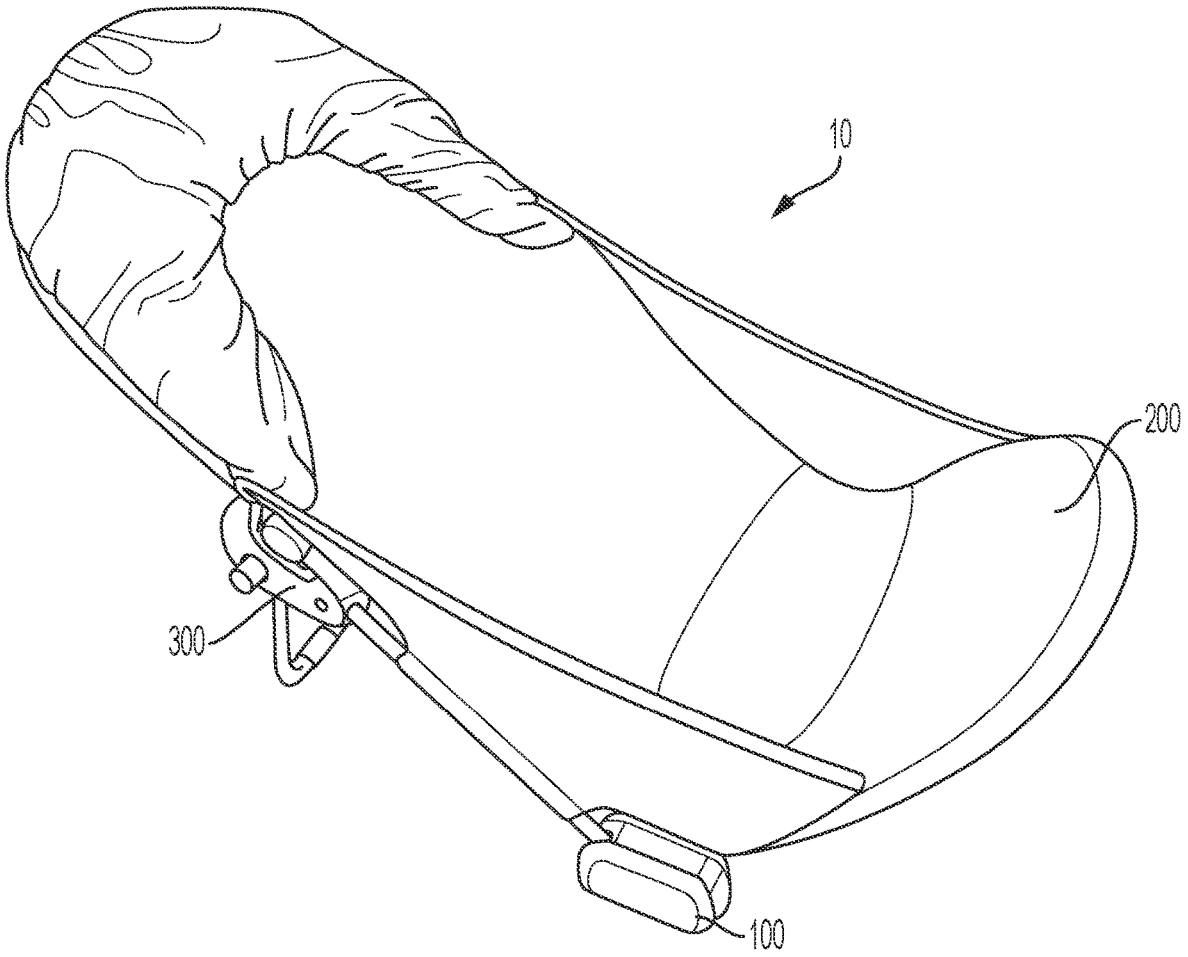
FIG. 1 is a perspective view of a folding baby bath seat in a use position according to an example embodiment of the present disclosure.

The various embodiments of the sleep surface and their advantages are best understood by referring to FIGS. 1 through 6 of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, FIGS. 1-6 show a folding baby bather or bath seat 10 according to an example embodiment of the present disclosure. The bath seat 10 generally comprises a frame assembly 100, a seat assembly 200, and a folding mechanism 300.

Figure 2:
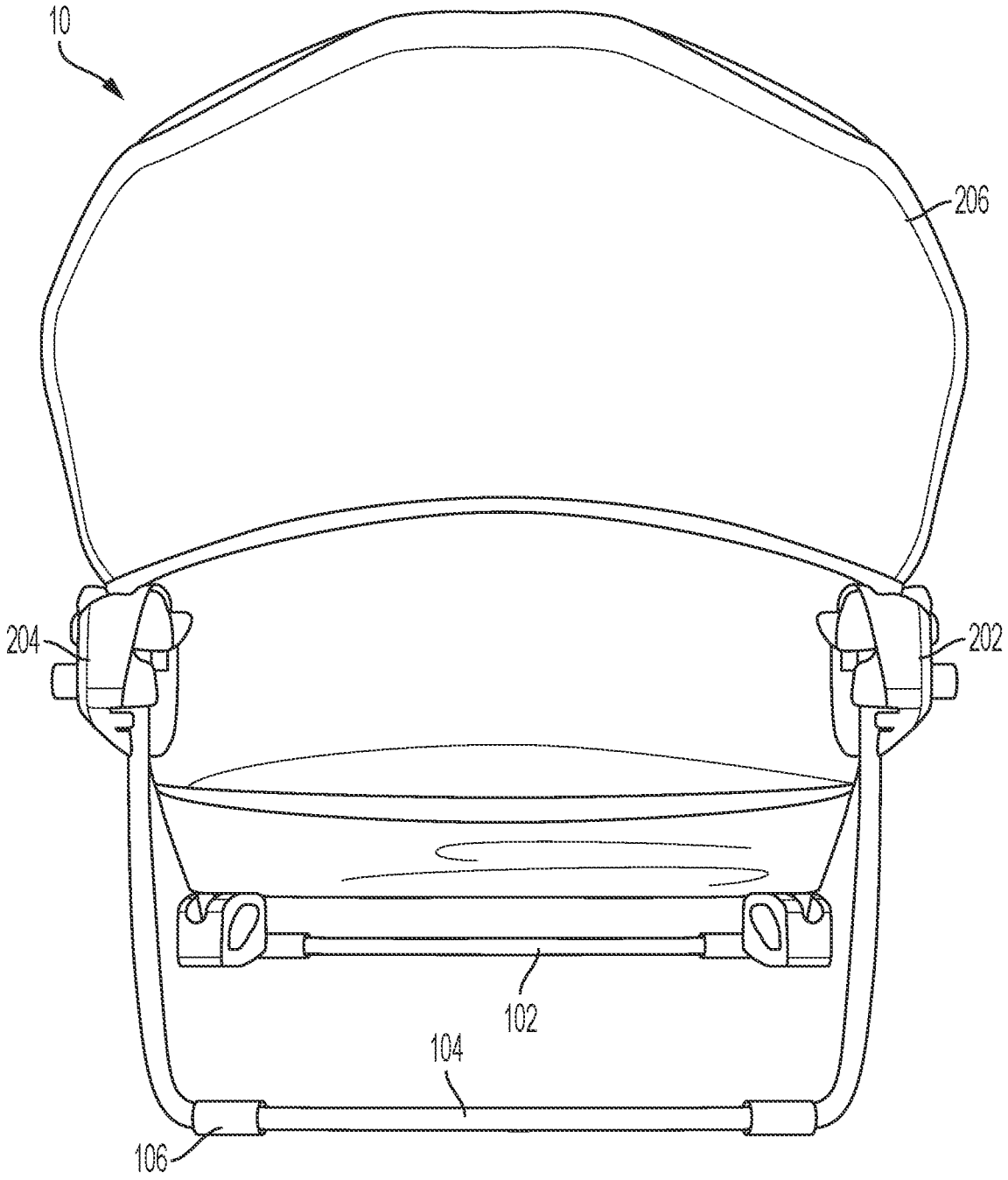
FIG. 2 is a rear view of the folding baby bath seat of FIG. 1.

As shown in FIGS. 1 and 2, in example embodiments, the bath seat 10 comprises a seat assembly 200 that is supported above a support surface by a frame assembly 100. Although described as a bath seat, the seat may be used on any suitable flat support surface. As shown in FIG. 2, the frame or frame assembly 100 includes a front or first floor-engaging portion 102 and a second or rear pivotally coupled floor-engaging portion 104. The first and second floor-engaging portions 102, 104 include one or more anti-slip grip pads 106 that engage with the support surface to prevent slipping or movement of the bath seat 10 on various support surfaces constructed from various materials and when in contact with water. The second or rear floor-engaging portion 104 is generally U-shaped. In alternate embodiments, the floor-engaging portion 104 may be any suitable shape. For example, the floor-engaging portion 102 may comprise two separate I-shaped portions, two T-shaped portions, or any other suitable shape or configuration that will provide a stable support for the bath seat 10 on a support surface.

Figure 3A:
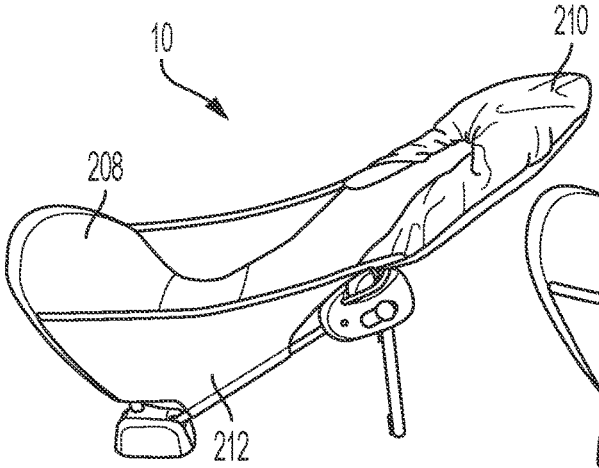
FIGS. 3A & 3B are side views of the folding baby bath seat of FIG. 1 transitioning from a first use position to a second use position.
Figure 3B:
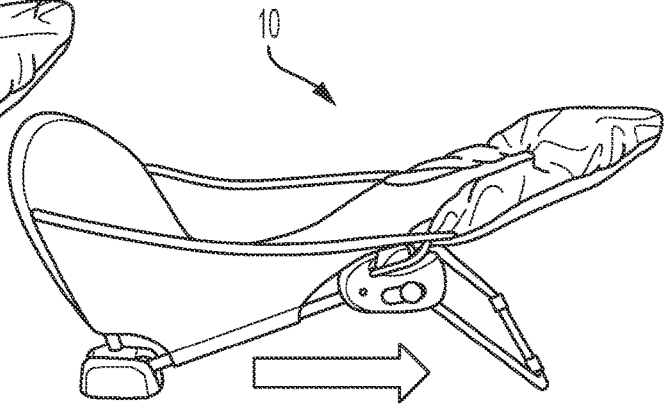

In example embodiments, the second floor-engaging portion 104 is pivotally coupled to the seat assembly 200 via folding mechanism 300. The folding mechanism 300 includes a first pivot assembly 202 and a second pivot assembly 204. The second pivot assembly 204 is generally a mirror image of the first pivot assembly 202. Each pivot assembly 202, 204 includes an actuator for allowing the second floor-engaging portion 104 to pivot with respect to the seat assembly 200. In alternate embodiments, the bath seat 10 may only include a single pivot assembly. In particular embodiments, the pivot assemblies also allow the angle of the back rest 206 of the seat assembly 200 to be adjusted from an inclined position to a reclined position. Although described as a two-position system, any number of incline/recline positions may be achievable by adding additional stops (not shown or numbered) to the pivot assemblies 202, 204, as shown in FIG. 3. Although shown in a fixed position, in alternate embodiments, the seat assembly 200 may be further pivotally coupled to the front floor-engaging portion 102.

Figure 4:
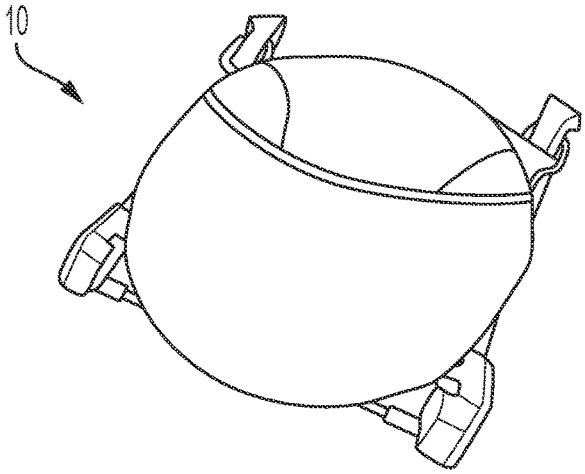
FIG. 4 is a top view of the folding baby bath seat of FIG. 1 in a folded configuration.

According to a particular embodiment, the seat assembly 200 includes a seat portion 208, a backrest 210, and one or more vertical side walls 212 extending upward from the seat portion. As shown in FIGS. 3 and 4, the backrest 210 is also pivotally coupled to the pivot assemblies 202, 204. This allows the bath seat 10 to be folded into a compact, flat configuration for storage or travel.

Figure 5:
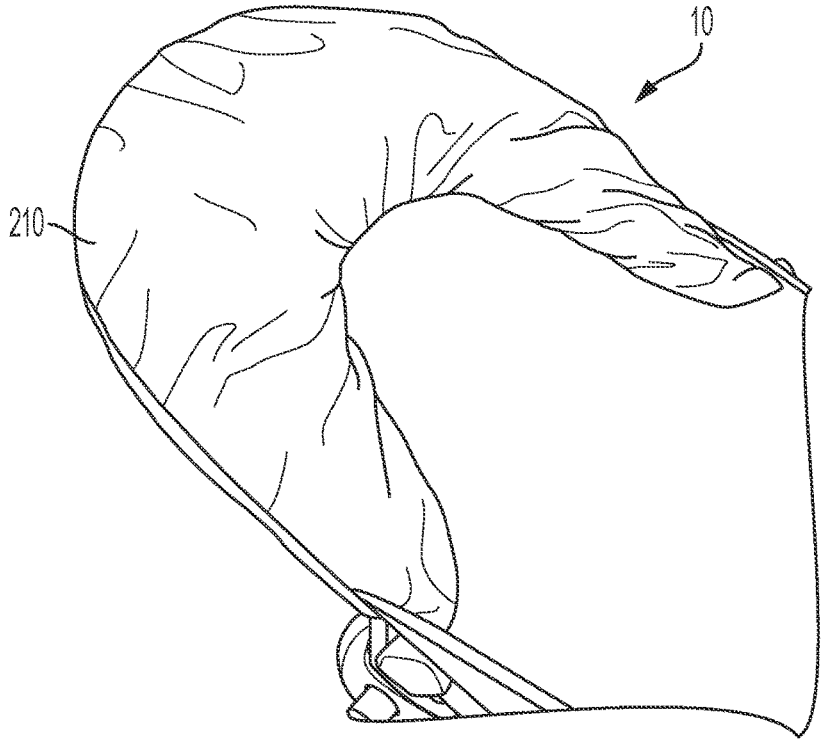
FIG. 5 is a partial perspective view of the headrest of the folding baby bath seat of FIG. 1.

Referring to FIG. 5, the bath seat 10 includes extra padding in the backrest 210 to provide a more comfortable environment for the infant. In example embodiments, the bath seat 10 is formed of a mesh material that is permeable to water. In particular embodiments, the material may be a quick-drying material. In example embodiments, the seat assembly mesh material is removable and machine-washable for easy cleaning.

Figure 6:
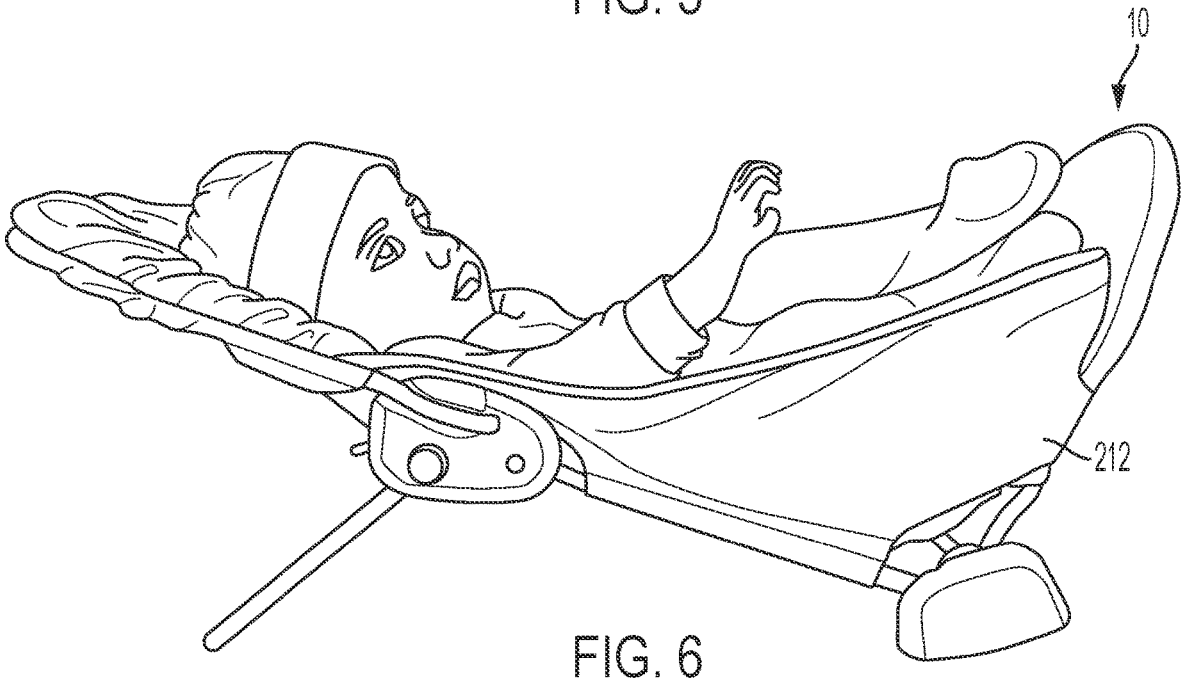
FIG. 6 is a side view of the of the folding baby bath seat of FIG. 1.

Referring now to FIG. 6, the side walls 212 of the bath seat 10 are also formed from a mesh, water-permeable material. The side walls 212 help retain the child while in bath seat 10 so that the infant does not roll or fall out of the seat. Although shown in a particular shape, size, and height, the side walls 212 may be any particular shape or height that would prevent the infant from falling out of the seat 10.

The bath seat 10 is beneficial in that it allows a user to bathe an infant safely and securely. The soft mesh sling cradles the infant, while the soft bolster headrest provides gentle support where the child needs it most. With two recline positions, a caregiver can give the child the most comfortable bathing experience for their first sponge bath and beyond. The compact fold design makes it the perfect bathing solution for both home and travel. In addition, because the bath seat 10 has such a small footprint, it can easily be used in a sink or an adult bathtub.

As described above and shown in the associated drawings, the present invention comprises a folding baby bath seat. While particular embodiments have been described, it will be understood, however, that any invention appertaining to the apparatus/system/method described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A baby seat comprising:

a seat assembly that is supported above a support surface by a frame assembly, the frame assembly comprising:

a front floor-engaging portion; and a rear floor-engaging portion, the rear floor-engaging portion pivotally coupled to the seat assembly by a folding mechanism, the rear floor-engaging portion moveable in at least two positions, the folding mechanism comprising a first pivot assembly and a second pivot assembly, each of the pivot assemblies comprising an actuator that enables the rear floor-engaging portion to pivot with respect to the seat assembly.

2. The foldable baby bath seat of claim 1, further comprising a plurality of non-stick pads mounted on said forward and rear floor-engaging portions.

* * * * *